United States Patent [19]

Ideno et al.

[11] Patent Number: 4,615,542

[45] Date of Patent: Oct. 7, 1986

[54] TELESCOPIC RISER JOINT

[75] Inventors: Eiichiro Ideno; Masaru Tamiya, both of Kobe; Katsumi Ogawa, Hyogo; Tadashi Kumakiri, Nara, all of Japan

[73] Assignee: Agency of Industrial Science & Technology, Tokyo, Japan

[21] Appl. No.: 594,915

[22] Filed: Mar. 29, 1984

[30] Foreign Application Priority Data

Mar. 29, 1983 [JP] Japan ..... 58-51632

[51] Int. Cl.[4] ..... F16L 27/00

[52] U.S. Cl. ..... 285/11; 285/101; 285/95; 285/302; 285/137.1; 285/900; 166/352; 166/355

[58] Field of Search ..... 285/10, 11, 95, 100, 285/101, 137 R, 302, 298, DIG. 1; 166/352, 353, 355

[56] References Cited

U.S. PATENT DOCUMENTS

| | | | |
|---|---|---|---|
| 853,964 | 5/1907 | Doolittle | 285/302 |
| 853,974 | 5/1907 | Hayden | 285/302 |
| 915,502 | 3/1909 | Struer | 285/302 |
| 1,513,315 | 10/1920 | Cook | 285/302 |
| 3,353,851 | 11/1967 | Vincent | 285/302 |
| 3,643,751 | 2/1972 | Crickmer | 166/355 |
| 3,746,372 | 7/1973 | Hynes et al. | 285/95 |
| 3,955,621 | 5/1976 | Webb | 166/355 |
| 4,367,981 | 1/1983 | Shapiro | 166/355 |

FOREIGN PATENT DOCUMENTS

| | | | |
|---|---|---|---|
| 1198146 | 8/1965 | Fed. Rep. of Germany | 285/302 |

*Primary Examiner*—Cornelius J. Husar
*Assistant Examiner*—Eric K. Nicholson
*Attorney, Agent, or Firm*—Oblon, Fisher, Spivak, McClelland & Maier

[57] ABSTRACT

This invention relates to a joint for risers, and particularly to a telescopic joint suitable for expandably connecting composite-pipe type riser pipes provided internally with tubing pipes. Its structural features reside in that connectors adapted to connect risers in up-and-down relationship are slidably engaged with each other and air cylinders capable of cancelling volume changes of the engaged portions, which volume changes occur due to expansion and contraction movements of the connectors, are communicated to the spacing of the engaged portions, and hydraulic cylinders adapted to cancel volume changes of the engaged portions of an internally-threaded nose portion and an externally-threaded nose portion, which engaged portions serve to communicate the upper and lower tubing pipes to each other, is communicated with the spacing of the engaged portions of the nose portions.

2 Claims, 6 Drawing Figures

TELESCOPIC RISER JOINT

FIELD OF THE INVENTION

This invention relates to a joint for risers used in underwater petroleum exploration, and especially to a telescopic joint suitable for use in expandably connecting composite-tube type riser pipes which are individually equipped with internal tubing pipes.

DESCRIPTION OF THE PRIOR ART

Offshore platforms (fixed platforms) are dominantly used these days to operate offshore oil fields. Coupled with the increased trend toward petroleum production from deeper sea areas, the installation of such fixed platforms as mentioned above has been approaching its limitation for economical and technical reasons.

To cope with the above limitation, it has been developed the so-called submarine petroleum production system as a production system which does not rely upon conventional offshore platforms. According to the submarine petroleum production system, many portal units (oil well portal units) are arranged on the sea floor, petroleum portions recovered from the portal units are combined together still on the sea floor, and the thus-combined petroleum is guided to the surface of the sea, followed by its processing, storage and shipping.

In such a submarine petroleum production system, each underwater portal is connected to a maintenance and inspection ship, which floats on the sea, by means of a plurality of pipes which are generally called "risers". Through such risers, the hydraulic unit of the portal unit is operated to carry out the maintenance and inspection of the portal unit and the oil collection work from the portal unit.

The above-mentioned work or operation, which is carried out through the risers, will next be described in more detail. A position controller is provided with the lower extremity of risers lowered vertically in the sea from a maintenance ship. By the position controller, the risers are placed right about a portal and the lower extremity of the risers is then inserted into the portal.

After completion of such a positional control and coupling of the risers to the portal, the hydraulic unit installed in the portal is operated by means of a hydraulic piping arranged in the risers so as to conduct a variety of maintenance and inspection work. Risers adapted to perform such maintenance and inspection work or to install or recover such portal units are called reentry risers. It is typical that such reentry risers are each internally provided, besides the aforementioned hydraulic piping, with two tubing pipes, one for collection of crude oil and the other for cleaning work of tubing pipe in the portal by means of a wire line and pump down tool.

By the way, it is required to keep the lower extremity of such risers in a state fixed to the portal unit on the sea floor when one wants to clean up the tubing pipe in the portal. The upper extremity of the risers is however connected to a maintenance ship which moves up and down due to waves. If the upper extremity of the risers should be fixed to the maintenance ship, the risers will be subjected to buckling and excess tensile forces due to up-and-down movements of the maintenance ship, leading to early-stage damages of the risers.

It is thus proposed to attach the upper extremity of the risers generally in a floating fashion to the ship and at the same time, to connect the upper extremity of each hydraulic piping with its respective hydraulic source by way of a flexible pipe attached to the upper extremity of the hydraulic piping so that the upper extremity of the risers is allowed to undergo up-and-down movements relative to the ship in accordance with the up-and-down movements of the ship. In the case of reentry risers, tubing pipes are generally housed within such reentry risers. It is however infeasible to use connectors having small curvatures, such as flexible tubes, for these tubing pipes, because they are used to carry out cleaning operations by means of a wire line and pump down tool.

SUMMARY OF THE INVENTION

With the foregoing in view, an object of this invention is to provide a special riser-connecting mechanism capable of allowing up-and-down movements of a ship while fixedly connecting the lower extremity of risers, which are internally equipped with tubing pipes, to a portal on the sea floor and fixing the upper extremity of the risers on the ship.

This invention therefore provides a telescopic riser joint having such a structure that connectors are provided with connecting portions of risers and are slidably engaged with each other so as to absorb up-and-down movements of a ship by sliding movements of the connectors while fixing the lower extremity of the risers to the sea floor, and volume changes of sliding portions, which changes occur during sliding movements of the connectors, are smoothly absorbed and leakage of working oil from tubing pipes to the joint is absorbed by housing the tubing pipes within the joint.

Figure 1:
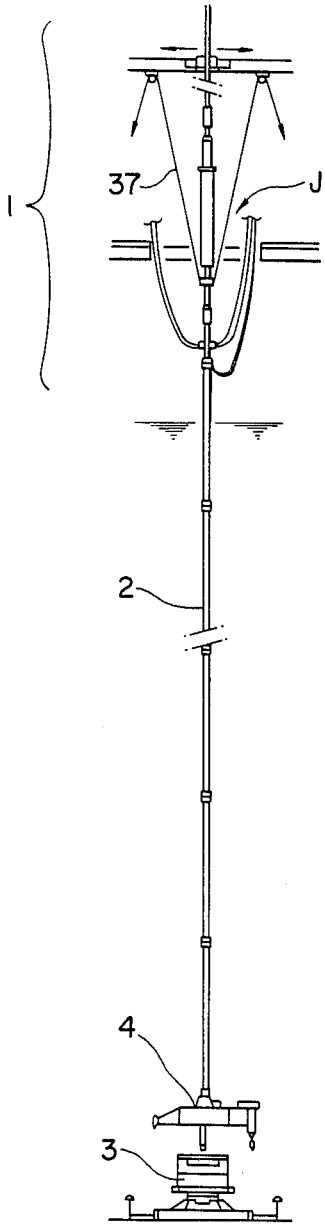
FIG. 1 is a schematic side view of overall risers equipped with a telescopic joint according to this invention, illustrating the way of use of the risers.
Figure 2:
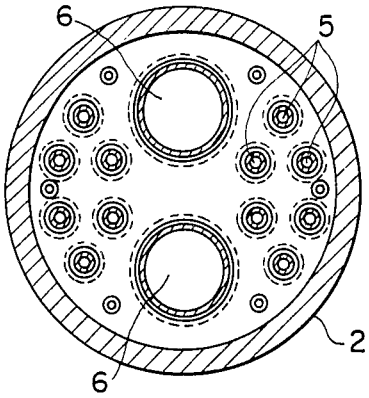
FIG. 2 is a transverse cross-sectional view of a riser.

FIG. 1 illustrates the way of use of risers equipped with a telescopic joint. In the figure, there are illustrated a ship 1, risers 2, portal unit 3 and position controller 4. On the other hand, FIG. 2 shows a cross-sectional structure of a reentry riser, in which a plurality of small-diametered pipings 5 are pipings for hydraulic working oil and two large-diametered pipings 6 are the above-mentioned tubing pipes.

DETAILED DESCRIPTION OF THE INVENTION

Figure 4:
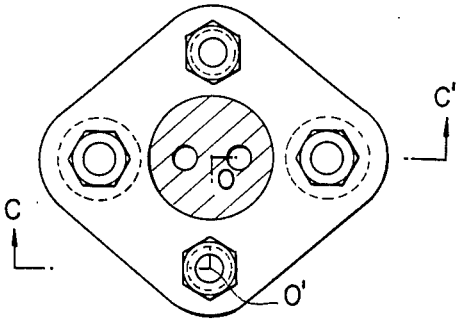
FIG. 4 is a cross-sectional view, taken along line B—B of FIG. 3.
Figure 5:
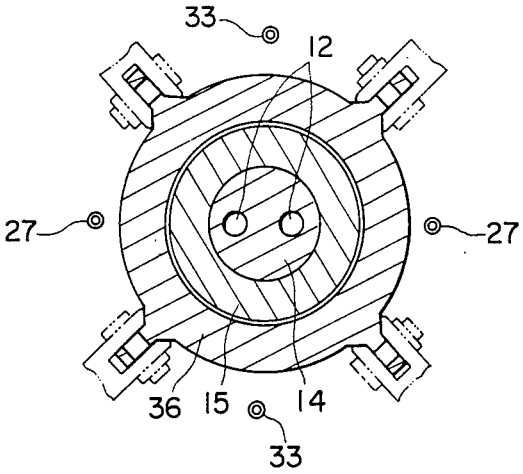
FIG. 5 is a cross-sectional view, taken along line A—A of FIG. 3.
Figure 3:
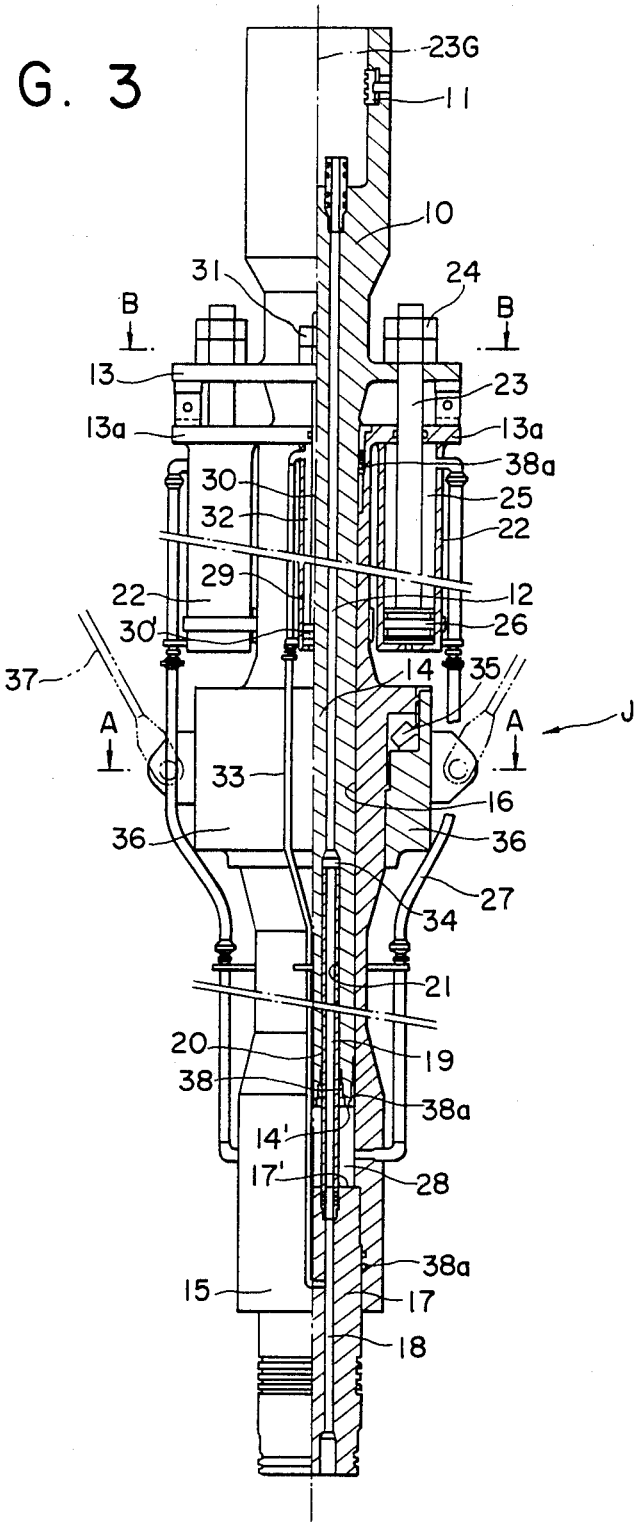
FIG. 3 is a cross-sectional side view of a telescopic joint according to the first embodiment of this invention, taken along line C-13 O'—O–C' of FIG. 4.

With reference to FIG. 3 to FIG. 6 of the accompanying drawings, one embodiment in which the present invention has been actually incorporated will be described. FIG. 3 is a side cross-sectional view of a telescopic joint J according to the one embodiment of this invention. FIG. 3 is a cross-sectional view taken along line C—O'—O—C' of FIG. 4. FIG. 4 is a cross-sectional view taken along line B—B of FIG. 3. FIG. 5 is a cross-sectional view taken along line A—A FIG. 3. In the embodiment illustrated in these drawings, an upper connector 10 is fixed to a ship-side riser while a lower connector 15 is secured fixedly to a portal-side riser which is placed underneath the ship-side riser.

In FIG. 3, the connector 10 is fixed to an unillustrated riser pipe, which assumes a position on a ship, by means of a connector element 11. The connector 10 defines two tubing passageways 12, which extend parallelly in the axial direction through the interior of the connnector 10. The tubing passageways 12 are communicated respectively with unillustrated tubing pipes housed in a riser which is connected at its upper end to the telescopic joint J. The tubing passageways 12 serve as passageways for wireline operations and pump down tool operations. The connector 10 is equipped at a certain point between its upper and lower ends with a horizontal flange 13. It defines at a lower part thereof a cylindrical engagement portion 14 which permits establishment of a slidable engagement with a below-described connector. The engagement portion 14 of the connector 10 is fit in an axially-slidable fashion within a cylindrical sliding hole 16 bored axially through a central part of a substantially-cylindrical, connector 15. The lower opening of the sliding hole 16 is closed up by a cylindrical end plate 17 which serves as a connecting portion for a riser to be connected to the lower end of the joint. Through the end plate 17, there are bored two tubing passageways 18 parallelly to each other and coaxially with their corresponding tubing passageways 12 bored through the connector 10. To the upper extremity of the tubing passageway 18, there is upwardly fixed a cylindrical nose portion 20 defining a communication passage 19 having an inner diameter equal to the inner diameters of the tubing passageway 18 and tubing passageway 12 and bored axially through the nose portion 20. The nose portion 20 is inserted slidably in the axial direction within a nose portion insertion hole 21 which is bored in a lower end portion of the tubing passageway 12, which is in turn bored in the engagement portion 14, in such a way that the insertion hole 21 and passageway 12 are communicated to each other. Incidentally, all of the numerals 38,38*a* indicate sealing members such as O-rings.

On the lower face of the flange 13*a* provided with the connector 15 at a certain position between the upper and lower extremities thereof, two air cylinders 22 are mounted symmetrically relative to the central axis 23G of the risers and telescopic joint J. The upper end portions of piston rods 23 of the air cylinders 22 are fixedly secured to the flange 13 by means of nuts 24. The volume of an air compartment 25 in each of the air cylinders 22 changes in accordance with the up-and-down movement of its corresponding piston 26 coupled fixedly with the piston rod 23. Each of the air compartments 25 is communicated via a flexible hose 27 to a volume-variable spacing 28 which is surrounded by the upper face 17' of the end plate 17, the inner wall of the sliding hole 16, the lower face 14' of the engagement portion 14 and the outer face of the nose portion 20. The cross-sectional areas of the air compartment 25 and piston rod 23 of each air cylinder 22 are determined in such a way that the effective cross-sectional area of the spacing 28, namely, the difference obtained by subtracting the cross-sectional area of the nose portion 20 from the cross-sectional area of the sliding hole 16 becomes equal to the sum of the effective cross-sectional areas of the air compartments 25,25 of the left and right air cylinders 22,22, in other words, the area obtained by subtracting the cross-sectional areas of the two piston rods 23,23 from the cross-sectional areas of the two air compartments 25,25 of the two air cylinders 22,22.

Furthermore, two small hydraulic cylinders 29,29 are provided parallelly to each other with the flange 13*a* at positions offset over 90° from the air cylinders 22,22. Piston rods 30,30 of the hydraulic cylinders 29,29 are fixed to the flange 13 by means of nuts 31. The oil compartment 32 of each of the hydraulic cylinders 29,29 is communicated via a flexible hose 33 to the tubing passageway 18 bored in the end plate 17. Since the tubing passageway 18 is in communication with the tubing passageway 12 by way of the communication hole 19, the oil compartment 32 is in communication with an upper spacing 34 formed in the nose portion 20 placed in the nose portion insertion hole 21 which is communicated to the tubing passageway 12. The total effective area of the oil compartments 32 of the two oil cylinders 29, namely, the area obtained by subtracting the cross-sectional areas of the two piston rods 30 from the cross-sectional areas of the oil compartments 32 is determined in such a way that it becomes equal to the total effective cross-sectional area of the nose portion 20, namely, the area obtained by subtracting the total cross-sectional area of the two communication holes from the total cross-sectional area of the two nose portions 20.

By the way, a tensioner ring 36 is provided on the outer circumferential wall of the connector 15 by way of thrust bearing 35. The tensioner ring 36 is adapted to pull the connector 15 upwardly by a constant pull-up force which is applied from four directions by wires 37, thereby protecting lower risers from being buckled.

Figure 6:
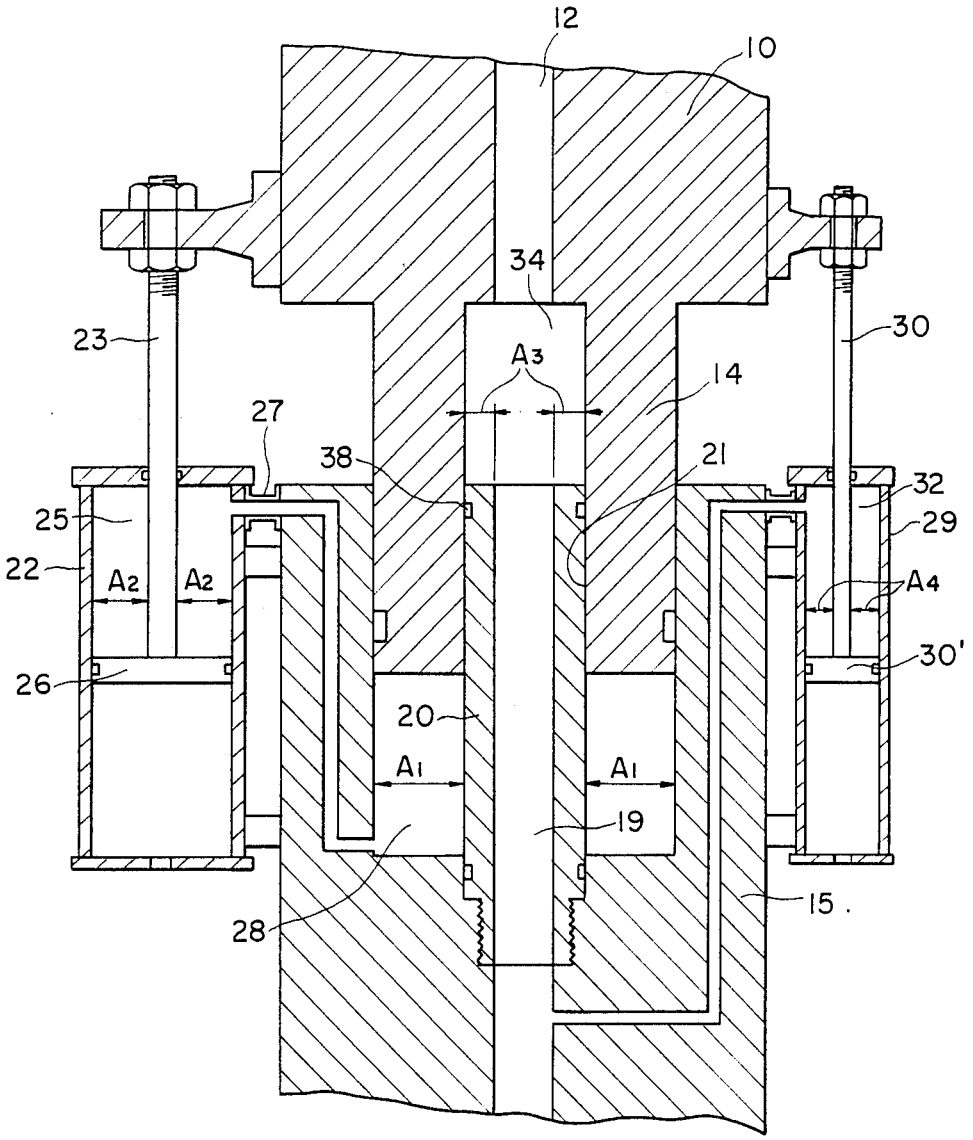
FIG. 6 illustrates the operation of a telescopic joint according to this invention.

Operation of the above-described telescopic joint will next be described with reference to FIG. 3 and FIG. 6 so that the telescopic joint according to this invention will be described in further detail. When the ship moves up and down in accordance with the up-and-down movement of the sea level, the connector 10 fixed to the ship-side riser also move vertically. Since the connector 10 is capable of undergoing axial sliding movement relative to the connector and the sliding hole 16 in which the engagement portion 14 is inserted, the connector 15 fixed to the seabed-side riser via the end plate 17, may be kept connected with the connector 10 while their vertical positions are fixed. Let's now assume that the connector 10 is pulled upwardly owing to a movement of the ship. The upward movement of the connector 10 causes the piston rods 23 and pistons 26, which are fixedly coupled with the connector 10, to move upwardly. Air is then forced out from the air compartments 25 of the air cylinders 22 through the flexible hoses 27. The thus-forced out air is thereafter allowed to flow in its entirety into the spacing 28. Since the effective cross-sectional area A1 of the spacing 28 is equal to the total effective cross-sectional area A2 of the air compartments 25 of the air cylinders 22 and the extents of movements of the pistons 26 are the same as the extent of movement of the connector 10 relative to the connector 15, air equivalent in volume to the volume expansion of the spacing 28 is supplemented from the air cylinders 22 to maintaIn the pressure at a constant level within the spacing 28. When the engagement portion 14 of the connector is pulled upwardly from the connector 15, the internal pressure of the spacing 28 is reduced to avoid such an inconvenience that the movement of the connector 10 would be impaired.

Since the nose portion 20 is inserted in the nose portion insertion hole 21 to maintain the linear communication of the tubing pipes in the structure of this invention, the pressure of the working oil in the spacing 34 acts on the upper end portion of the nose portion 20 and produces via the nose portion 20 a force which presses the connector 10 upwardly. Since the spacing 34 is in communication with the oil compartments 32 of the hydraulic cylinders 29 and their effective cross-sectional areas A3 and A4 are equal to each other, the same pressure as the pressure applied to the end portion of the nose portion 20 acts as a force pushing the pistons 30' and piston rods 30 of the hydraulic cylinders 29 fixed on the connector 15 downwardly. These upward and downward forces are balanced, thereby cancelling axial thrusts exerted on the connector 10.

The sealing member 38 such as O-ring is inserted in the sliding part between the nose portion 20 and nose portion insertion hole 21. Even if an oil leak occurs due to breakage of the sealing member 38, the thus-leaked oil is guided to the air compartments 25 of the air cylinders 22 and is thus successfully prevented from developing such an inconvenience that it leaks out of the joint because the spacing 28 is in communication with the air compartments 25 of the air cylinders 22 in the present invention.

The above embodiment of this invention has been described in connection with the telescopic joint suitable for use in combination with reentry risers. It should however be borne in mind that the present invention is not only be applied to such reentry risers but is also applicable for example to composite-tube type production risers which are used to recover oil from small oil fields.

As has been described in detail, the present invention provides a telescopic riser joint adapted to connect a riser pipe, which is fixed with a sea floor portal and is internally equipped with a plurality of tubing pipes, slidably in the axial direction thereof with a riser pipe secured fixedly to a ship, comprising:

an upper connector and a lower connector, which are fit together with the latter fit over the former and are both slidable axially;

a nose portion fit slidably within a nose portion insertion hole communicating with tubing pipes bored in the lower connector and defining a communication hole which communicates with tubing pipes fixedly provided in the upper connector at radially inner parts thereof; and air cylinders mounted fixedly on the outer wall of one of the connectors in such a way that the air cylinders are parallel to the central axis of the one of the connectors and are symmetrical relative to the central axis of the one of the connectors, the total effective cross-sectional area of said air cylinders being equal to the effective cross-sectional area of the engaged portions of the upper connector and the lower connector, the air compartments of said air cylinders being in communication with a volume-variable spacing of the engaged portions of the upper connector and the lower connector, and the distal ends of the piston rods of said air cylinders being secured fixedly to the other connector. The above-mentioned structure of the telescopic riser joint permits one of the connectors, to slide freely in the axial direction in accordance with the movement of the ship, relative to the riser fixed to the portal in the sea floor and the other connector coupled with the riser. Therefore, that flexible joint can connect a riser pipe, fixed to a portal in the sea floor, linearly to a riser pipe fixed on the ship. Therefore, the telescopic joint is most suitable for cleaning tubing pipes by means of a wire line or pump down tool. In addition, air forced out from the joint or required additionally for the joint upon sliding movements of the connectors can be taken out or can be supplemented owing to the interlocked operations of the air cylinders and any working oil which may be leaked out from the tubing pipes or the like can be kept in the air cylinders. Therefore, the telescopic joint of this invention is free from such an inconvenience that oil is allowed to leak continuously to the outside and can maintain an extremely smooth sliding state without applying any forces which may buckle or pull the lower risers fixed to the portal. Furthermore, the telescopic joint of this invention can prevent the slip-off of the connectors because the telescopic joint is constructed in such a way that each pulling force applied to the connectors due to the pressure of the crude oil at its communication passageways with tubing pipes is balanced by the hydraulic cylinders.

We claim:

1. A telescopic riser joint adapted to axially slidably connect a riser pipe, which is fixed with a sea floor portal and is internally equipped with a plurality of tubing pipes, with a riser pipe secured fixedly to a ship, comprising:

an upper connector and a lower connector, which are axially slidably fit together with the latter fit over the former a nose portion fit slidably within a nose portion insertion hole communicating with said tubing pipes in said upper connector and fitted in said lower connector, said nose portion defining a communication passage which communicates with tubing pipes fixedly provided in said lower connector at radially inner parts thereof; and air cylinders mounted fixedly on the outer wall of one of the connectors in such a way that the air cylinders are parallel to the central axis of the one of the connectors and are symmetrical relative to the central axis of the one of the connectors, the total effective cross-sectional area of said air cylinders being equal to the effective cross-sectional area of a volume variable space between the facing surfaces of the upper connector and an element fixed to the lower connector, the air compartments of said air cylinders being in communication with said volume-variable space, and the distal ends of piston rods of said air cylinders being secured fixedly to the other said connector.

2. A telescopic riser joint adapted to axially slidably connect a riser pipe, which is fixed with a sea floor portal and is internally equipped with a plurality of tubing pipes, with a riser pipe secured fixedly to a ship, comprising:

an upper connector and a lower connector, which are axially slidably fit together with the latter fit over the former;

a nose portion fit slidably within a nose portion insertion hole communicating with said tubing pipes in said upper connector and fitted in said lower connector, said nose portion defining a communication passage which communicates with tubing pipes fixedly provided in said lower connector at radially inner parts thereof;

air cylinders mounted fixedly on the outer wall of one of the connectors in such a way that the air cylinders are parallel to the central axis of the one of the connectors and are symmetrical relative to the central axis of the one of the connectors, the total effective cross-sectional area of said air cylinders being equal to the effective cross-sectional area of a volume variable space between the facing surfaces of the upper connector and an element fixed to the lower connector, the air compartments of said air cylinders being communication with said volume-variable space, and the distal ends of piston rods of said air cylinders being secured fixedly to the other said connector; and hydraulic cylinders mounted fixedly on the outer wall of said one of the connectors in such a way that the hydraulic cylinders are parallel to the central axis of the one of the connectors and are symmetrical relative to the central axis of the one of the connectors, the total effective cross-sectional area of said hydraulic cylinders being equal to the total effective cross-sectional area to the nose portion, oil compartments of said hydraulic cylinders being in communication with the tubing pipes of the one of the connectors, and the distal ends of piston rods of said hydraulic cylinders being secured fixedly to the other said connector.

* * * * *